United States Patent [19]

Maes

[11] Patent Number: 4,559,630

[45] Date of Patent: Dec. 17, 1985

[54] SYSTEM FOR MEASURING THE ARC VOLTAGE IN AN ELECTRIC FURNACE

[75] Inventor: Pascal Maes, Saint Romain en Giers, France

[73] Assignee: Clecim, Courbevoie, France

[21] Appl. No.: 538,861

[22] Filed: Oct. 4, 1983

[30] Foreign Application Priority Data

Oct. 15, 1982 [FR] France ..... 82 17253

[51] Int. Cl.[4] ..... H05B 7/07

[52] U.S. Cl. ..... 373/93

[58] Field of Search ..... 373/91, 92, 93; 266/86

[56] References Cited

U.S. PATENT DOCUMENTS 3,610,601 10/1971 Bishop, Jr. ..... 266/86 X 4,121,042 10/1978 Prenn ..... 373/93

4,256,918 3/1981 Schwabe et al. ..... 373/93

*Primary Examiner*—A. D. Pellinen

*Assistant Examiner*—Gregory D. Thompson

*Attorney, Agent, or Firm*—Pollock, Vande Sande & Priddy

[57] ABSTRACT

A system which permits the measurement, during operation, of the arc voltage electrodes having an upper metal portion (4) cooled by circulating water. The system employs an electrical instrumentation-cable (16) attached to a piece (5) for fixing the graphite consumable portion (3) of the electrode. This cable runs along the axis of the metal portion (4) and then inside one of the water-supply pipes (11), terminating at an electronic box (14) which converts the incoming measurement signal into a light wave.

5 Claims, 2 Drawing Figures

SYSTEM FOR MEASURING THE ARC VOLTAGE IN AN ELECTRIC FURNACE

FIELD OF THE INVENTION

The present invention relates to a system which permits the arc voltage to be measured during the operation of an electric furnace utilized for melting or converting ferrous scrap, measurements being made on each of the electrodes.

BACKGROUND OF THE INVENTION

An electric arc furnace is an apparatus which is designed for melting a metal charge, supplied in the form of bulk ferrous scrap, in order to obtain a bath of molten steel. This liquid metal may be refined in the arc furnace itself, in order to convert it into a steel possessing specified properties, or this refinement may not be carried out. The electric arc furnace is primarily a tool for melting ferrous scrap, and this is becoming increasingly noticeable in modern steel plants.

An arc furnace is equipped with three graphite electrodes. Each of the electrodes is equipped with a separate raising and lowering device which, during the melting of a charge of ferrous scrap, enables the electrode to be, at any moment, at the appropriate distance from the scrap. The arcs are struck between each of the electrodes and the charge to be melted. The current which flows in the electrodes is a three-phase alternating current, which is substantially balanced and has a magnitude of the order of tens of thousands of amperes. In comparison with the impedance of the arc, the power supply circuit presents an impedance which is not negligible, whereby the arc voltage represents only about 70 to 90% of the voltage at the transformer terminals. The impedance of the power supply circuit is predominantly reactive, and its value is not constant since it depends on the circuit geometry, which is essentially capable of being reshaped because the electrodes are vertically translatable, through several meters, during the period over which the arcs are established.

In order to enable the energy which is applied to the ferrous scrap in the furnace to be regulated in the desired manner, it is necessary to know the arc voltage at each of the electrodes on a continuous basis.

According to the prior art, the measurement of the arc voltage is derived from a calculation which starts with a measured voltage value, this measurement being made either at the terminals of the supply transformer or at the downline ends of the power supply cables which leave these terminals. The result of this measurement is very inaccurate, for the circuit impedance is variable, and its value cannot be determined at the moment at which the arc-voltage calculation is performed and, for this calculation, the impedance is assumed to have a constant mean value, an assumption which is necessarily inaccurate. In the case where the voltage is measured at the downline end of the supply cables, the measured voltage is incorrect due to the strong influence of the power currents, which induce error-voltages in the measuring circuit.

SUMMARY OF THE INVENTION

The measuring system according to the invention enables the arc voltage to be measured more accurately than heretofore. The system can be applied to electric furnaces which are equipped with electrodes of the type in which the upper portion is made of metal and is cooled by water-circulation, of the type described, for example, in U.S. Pat. No. 4,121,042, which discloses an arrangement wherein an instrumentation cable leaves the piece for fixing the graphite portion of the electrode, runs along the longitudinal axis of the cooled metal portion of the electrode, then runs inside one of the cooling water pipes, which may be either the supply pipe or the return pipe, terminates at an electronic unit for converting the incoming signal into light or some other electromagnetic wave, the converted signal then being routed to the control room, by means, for example, of an optical fiber.

BRIEF DESCRIPTION OF THE DRAWINGS

The invention will be more clearly understood with the aid of the following description of an illustrative embodiment, with reference to the accompanying drawings in which.

DETAILED DESCRIPTION OF A PREFERRED EMBODIMENT

Figure 1:
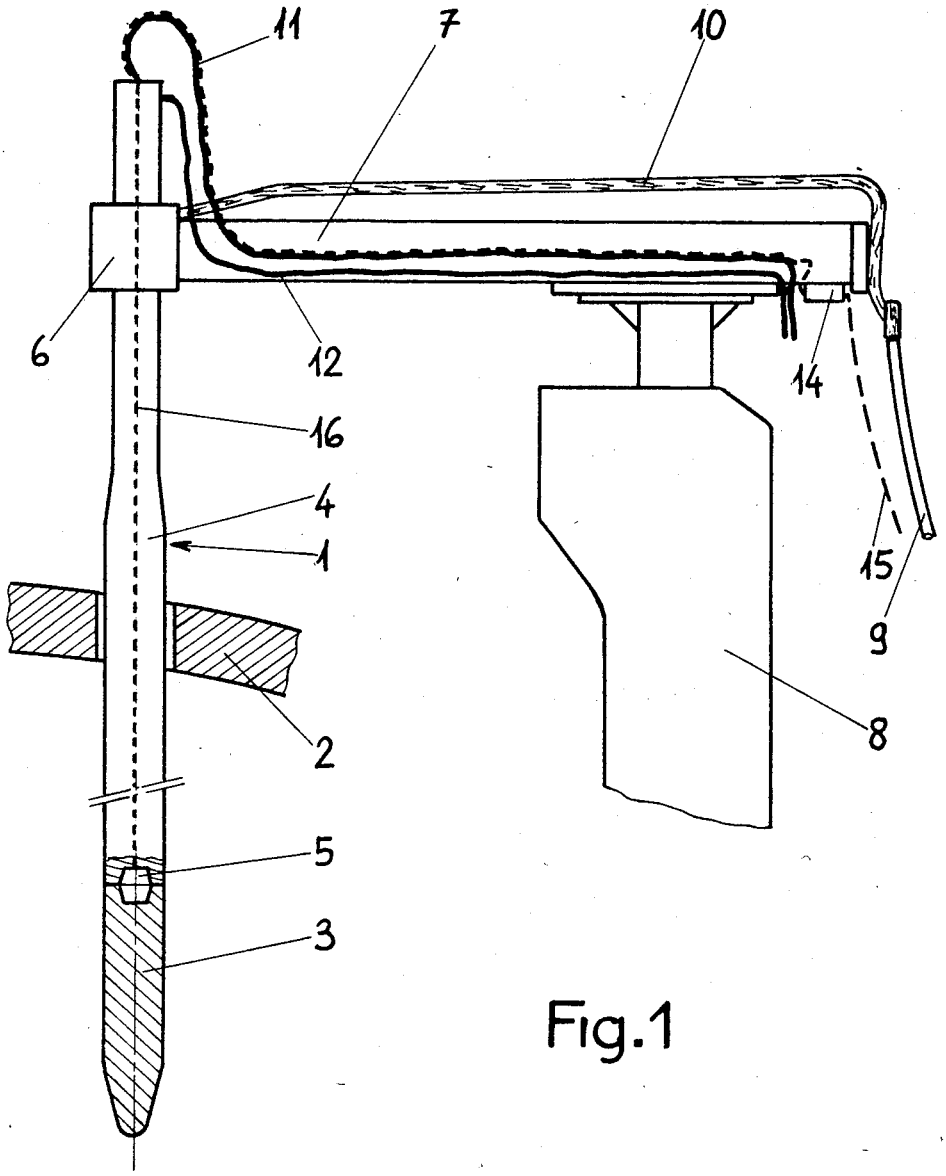
FIG. 1 is a diagrammatic view of the complete measuring system according to the invention.

FIG. 1 shows one of the three electrodes 1 which pass through the roof 2 of an electric-arc furnace, this electrode comprising a consumable graphite lower portion 3 and an upper, metal portion 4, which is cooled by water circulation, the two portions, 3 and 4, being joined by means of a threaded, double-tapered piece 5, known as a nipple screwed in female recesses 41, 31, formed at the adjacent ends, respectively, of the upper metal portion 4 and lower graphite portion 3 of the electrode. Electrodes of this type have been known for only a few years, and are described in several recent publications, such as, for example, U.S. Pat. No. 4,121,042.

The electrode 1 is held by means of a holder 6, which is located at the end of a supporting arm 7. The arm 7 is itself carried by a mast 8, the height of which can be adjusted by means of a conventional device (not shown).

The electrode voltage which is outputted from one of the three secondary-winding terminals of the three-phase supply transformer is applied to the metal holder 6 by means of power cables 9 and 10.

The metal portion 4 of the electrode 1 is cooled by means of a water circulation circuit, comprising a flexible water supply tube 11, terminating on the axis of the electrode, and a flexible water return tube 12, which leaves via the top of the electrode.

Figure 2:
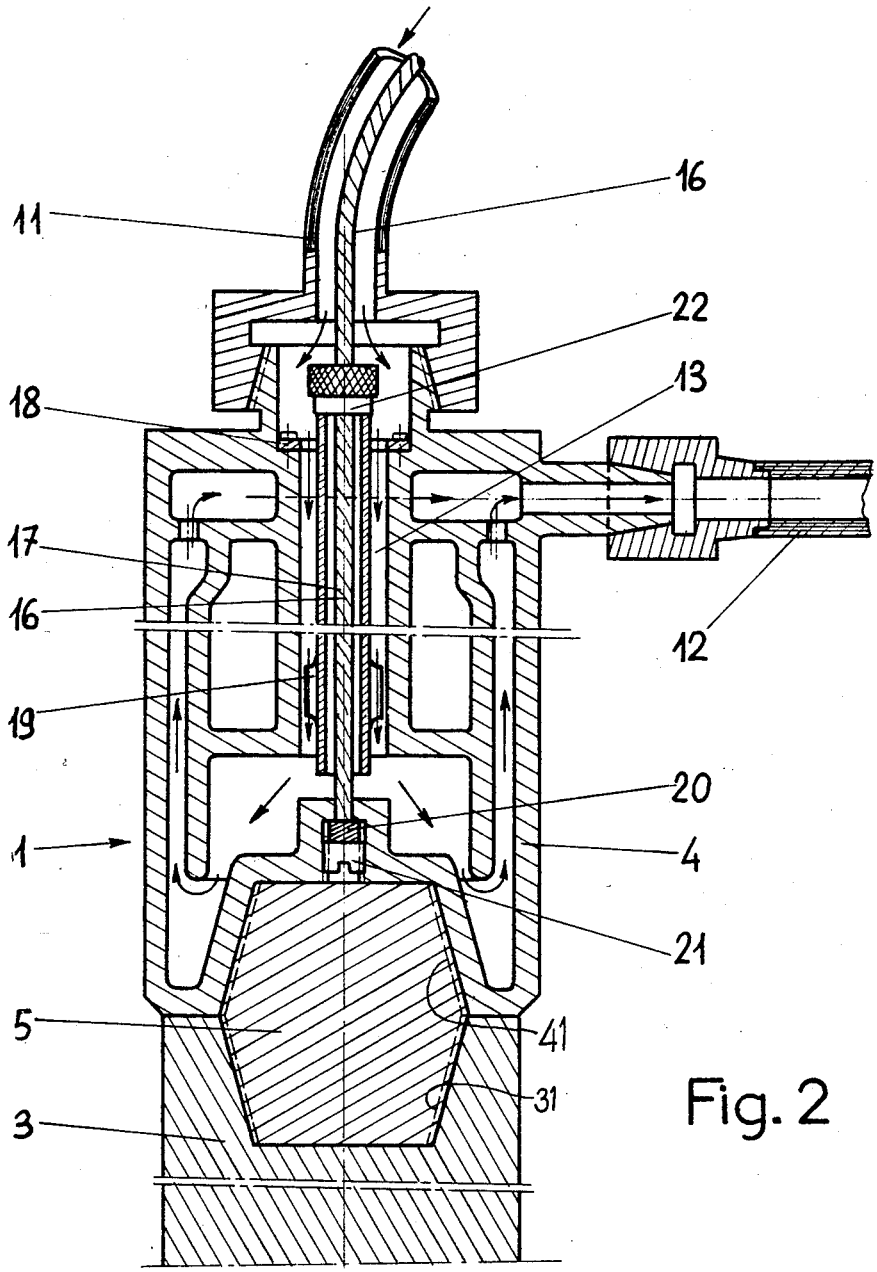
FIG. 2 is a view, in longitudinal section, of a cooled electrode which is equipped with the measuring system according to the invention.

In FIG. 2, it is possible to see in detail, the water circulation circuit inside the cooled metal portion 4 of the electrode 1. It will be seen that, in this metal portion, the water initially passes down an axial passage 13, running along the entire length of the cooled metal portion 4.

In accordance with the invention, an electrical instrumentation cable 16 electrically connected to nipple 5, runs along the axis of the metal, cooled portion 4, and then runs inside the water supply pipe 11, in order to terminate at an electronic box 14, which is located at the upline end of the supporting arm 7.

The electronic box 14 incorporates a device which measures the instantaneous voltage at the piece 5, i.e., at the downline end of the cooled, metal portion 4, which converts this measured voltage value into a root mean square voltage value, and which then converts this measurement into a light signal which is transmitted to the control room with the aid of an optical fiber 15. The received signal is used to regulate the vertical position of the mast 8, i.e., ultimately, the power of the arc.

The invention permits a major improvement in the measurement of the arc voltage. In effect, the voltage is measured on the connecting piece 5, i.e., very close to the end of the electrode 1, the instrumentation-cable 16 passing through the center of the metal portion 4, where there is no induction, due to the fact that there is no electromagnetic field at the center of a conductor.

The cable 16 then continues along its run inside the tubes 11 which supply the electrode with cooling water. Over this portion of the run, parasitic induction is present, but is attenuated by the fact that the instrumentation cable 16 is carefully screened by means of the actual material of the pipework. The measured voltage is converted into light inside the box 14, after which, transmitted by means of the optical fiber 15, it is no longer susceptible to perturbations.

FIG. 2 shows in detail the connections between the cooled, metal portion 4 and the downline portion of the instrumentation cable 16 and the flexible water supply tube 11.

In the central passage 13, through which the cooling water arrives, this water being supplied via the flexible tube 11 and circulating as indicated by the arrows, there is a coaxial tube 17, which is fixed at its upper portion by means of a flange 18, which is perforated in order to permit the water to circulate, and which is centered in the passage 13 by means of fins 19. The insulated conducting wire 16 is located on the axis of this tube 17, this wire 16 being integral, at its downline end, with a metal slug 20 which is firmly pressed against the bottom of the recess 41 at the lower end of the metal portion 4 of the electrode by means of a threaded plug 21. A waterproof socket 22 enables the instrumentation cable 16 to be connected and disconnected quickly.

I claim:

1. Apparatus which measures the arc voltage on a graphite electrode having a consumable lower portion (3) joined by a connecting piece (5) to an upper, metal portion (4), being cooled by means of an internal water circulation circuit comprising a supply conduit (11) and a return conduit (12), said apparatus comprising an electrical instrumentation cable (16) electrically connected to said connecting piece (5), passing along the longitudinal axis of said upper, metal portion (4) and then through the interior of one of said supply conduit (11) and return conduit (12).

2. Apparatus according to claim 1, wherein said cable (16) terminates at an electronic unit (14) converts an incoming voltage measurement signal into an electromagnetic wave, the converted signal then being routed to a control room.

3. Apparatus according to claim 2, wherein said electronic unit (14) converts said signal into a light wave, and is connected to said control room by means of an optical fiber.

4. Apparatus according to claim 1, wherein said water circulation circuit comprises a water supply passage (13) extending along the axis of said metal portion (4) over its entire length, said passage (13) containing a coaxial tube (17) inside which said cable (16) runs.

5. Apparatus according to claim 1, wherein a lower end of said cable (16) is integral with a metal slug (20) which is pressed firmly against said metal portion (4) of said electrode by means of a threaded plug (21).

* * * * *